US011302297B2

(12) United States Patent
Scully

(10) Patent No.: US 11,302,297 B2
(45) Date of Patent: Apr. 12, 2022

(54) REMOVABLE AND REVERSIBLE SLIDE MOUNT FOR MARINE TRANSDUCER

(71) Applicant: Kevin D Scully, Boynton Beach, FL (US)

(72) Inventor: Kevin D Scully, Boynton Beach, FL (US)

( * ) Notice: Subject to any disclaimer, the term of this patent is extended or adjusted under 35 U.S.C. 154(b) by 375 days.

(21) Appl. No.: 16/427,979

(22) Filed: May 31, 2019

(65) Prior Publication Data

US 2020/0380942 A1 Dec. 3, 2020

(51) Int. Cl.

| | |
|---|---|
| ***G10K 11/00*** | (2006.01) |
| ***B63B 17/00*** | (2006.01) |
| ***B63C 11/48*** | (2006.01) |
| ***H04R 1/02*** | (2006.01) |
| ***A47B 21/02*** | (2006.01) |

(52) U.S. Cl.
CPC ..... *G10K 11/006* (2013.01); *A47B 21/02* (2013.01); *H04R 1/02* (2013.01)

(58) Field of Classification Search
CPC ..... B63B 17/00; B63B 17/0018; B63B 49/00; B63B 25/002; B63C 11/48; G10K 11/006; G10K 11/004; A47B 21/02; H04R 1/02; H04R 1/025; H04R 1/026
See application file for complete search history.

(56) References Cited

U.S. PATENT DOCUMENTS 3,285,367 A * 11/1966 Isidore ..... B63B 27/14 182/97
3,740,706 A 6/1973 Joseph
3,752,431 A 8/1973 McBride
3,825,097 A * 7/1974 Owen ..... B63B 27/14 182/91
3,879,361 A 4/1975 Wyatt
3,989,213 A 11/1976 Allen
3,989,216 A * 11/1976 Veatch ..... G10K 11/004 248/278.1
4,198,070 A * 4/1980 Weiler ..... B60R 3/02 182/91
4,282,590 A 8/1981 Wingate
4,285,485 A * 8/1981 Burke ..... G10K 11/352 248/292.13

(Continued)

FOREIGN PATENT DOCUMENTS

CN 109250035 A * 1/2019

*Primary Examiner* — Edgardo San Martin
(74) *Attorney, Agent, or Firm* — Allen F. Bennett; Bennett Intellectual Property

(57) ABSTRACT

A removable and reversible sliding mount for a marine transducer has a C-shaped mounting channel affixed to the transom of a boat. A closed bottom end of the C-shaped mounting channel is proximal to the bottom of the boat and an open top end of the mounting channel is at or above the water line of the boat. A mounting board having a handle at one end and a transducer at the other end may be slid into the mounting channel so that the transducer is positioned just below the bottom of the boat. The mounting board may in be inverted so that the transducer is positioned above the waterline of the boat. A locking mechanism may be used to secure the mounting board in the mounting channel. The mounting board may also include cable guides to secure a transducer cable along its length.

9 Claims, 3 Drawing Sheets

(56) References Cited

U.S. PATENT DOCUMENTS 4,432,436 A * 2/1984 Suiter ..... B63B 27/14 114/343
4,719,872 A * 1/1988 Ritten ..... B63B 27/14 114/362
4,719,989 A * 1/1988 Ritten ..... B63B 27/14 114/362
4,781,350 A 11/1988 Boucher
4,928,915 A * 5/1990 Havins ..... G01S 7/521 248/288.31
4,979,153 A * 12/1990 Terry ..... A01K 79/00 340/573.2
4,980,872 A * 12/1990 Oler ..... G10K 11/355 367/104
4,982,924 A 1/1991 Havins
5,014,640 A * 5/1991 Owen, Sr. ..... B63B 27/14 114/362
5,016,225 A 5/1991 Blomberg
5,186,428 A 2/1993 Falkenberg
5,441,368 A * 8/1995 Campbell ..... B63B 59/04 114/222
5,458,080 A * 10/1995 Jaramillo, Sr. ..... B63B 27/14 114/362
5,529,272 A * 6/1996 Baublitz, Sr. ..... B63B 49/00 248/231.71
6,019,333 A 2/2000 Waller
6,065,420 A 5/2000 Smith
7,036,451 B1 * 5/2006 Hutchinson ..... B63B 17/00 114/364
7,548,490 B2 6/2009 Snyder
10,173,762 B1 * 1/2019 Gray ..... B63H 20/08
10,836,461 B1 * 11/2020 Smith ..... B63B 49/00
2009/0250563 A1 10/2009 Upchurch
2021/0120796 A1 * 4/2021 Hodges ..... B63B 17/00

* cited by examiner

REMOVABLE AND REVERSIBLE SLIDE MOUNT FOR MARINE TRANSDUCER

BACKGROUND OF THE INVENTION

Field of the Invention

The present invention relates to devices for mounting a transducer to a boat. More particularly, the invention relates to a sliding mount having an invertible mounting board that slides into a channel on the transom of the boat so that the transducer may be positioned either below the bottom of the boat or above the water line.

Description of the Related Art

Marine sonar units, e.g. fish finders or depth finders, use a transducer mounted on the bottom of the transom of the boat, generally located off center by a foot or so depending on the angle of the transom. Many problems occur with the transducer permanently installed under the water. Barnacles grow on the transducer, causing the unit not to function as designed or fail completely. There are paint products that retard barnacle growth, but coating the transducer with these products will cause the unit to not work as designed. Transducers also may picks up any derbies in the water such as, leaves, plastic bags, etc, while the boat is in use. Such debris cannot be removed without getting in the water. Transducers can also be inadvertently ripped right off the boat by a boat lift or trailer. When a transducer is damaged, it can only be repaired replaced by first taking a boat out of the water.

The above-described deficiencies of today's systems are merely intended to provide an overview of some of the problems of conventional systems, and are not intended to be exhaustive. Other problems with the state of the art and corresponding benefits of some of the various non-limiting embodiments may become further apparent upon review of the following detailed description.

In view of the foregoing, it is desirable to provide devices and methods for attaching a transducer to a boat that may be easily raised above the water line of the boat for cleaning or storage.

BRIEF SUMMARY OF THE INVENTION

Disclosed is a removable and reversible sliding mount for a marine transducer where the transducer is located at one end of an elongate mounting board having a handle at its opposite end. The mounting board may be slid into a mounting channel on the transom of the boat so that the transducer is positioned below the bottom of the boat. Alternatively, the mounting board may be inverted so that the transducer is positioned above the water line.

In one embodiment, a removable and reversible sliding mount for marine a transducer has a C-shaped mounting channel having a closed bottom end and an open top end. A mounting board has a first end and a second end and is configured to slide into and out of the open top end of the C-shaped mounting channel by inserting either the first end or the second end of the elongate mounting board into the open top end of the C-shaped mounting channel. The mounting board has a handle at the first end and a transducer attached to the second end of the elongate mounting board. A locking mechanism for secures the mounting board in the vertical C-shaped mounting channel. The C-shaped mounting channel is defined by a backwall, two parallel flanges, and two lips and is affixed to a transom of a boat.

In another embodiment, a method for storing a transducer above the waterline of a boat in water includes affixing to a transom of the boat a C-shaped mounting channel having a closed bottom end proximal to a bottom of the boat and an open top end positioned above a water line of the boat. The transducer is attached to a first end of a mounting board and a handle is attached at a second end of the mounting board. During use of the transducer, the mounting board is slid into the vertical C-shaped mounting channel by inserting the first end of the elongate mounting board into the open top end of the vertical C-shaped mounting channel. The transducer is stored above the water line by removing the elongate mounting board from the vertical C-shaped mounting channel, inverting the elongate mounting board, and sliding the elongate mounting board into the vertical C-shaped mounting channel by inserting the second end of the elongate mounting board into the open top end of the vertical C-shaped mounting channel. The mounting board is secured within the vertical C-shaped mounting channel using a locking mechanism.

It is therefore an object of the present invention to provide a removable and reversible slide mount for marine transducer having an invertible mounting board that is removably slidable into a C-shaped mounting channel.

These and other objects and advantages of the present invention will become apparent from a reading of the attached specification and appended claims. There has thus been outlined, rather broadly, the more important features of the invention in order that the detailed description thereof that follows may be better understood, and in order that the present contribution to the art may be better appreciated. There are features of the invention that will be described hereinafter and which will form the subject matter of the claims appended hereto.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein.

DETAILED DESCRIPTION

Figure 3:
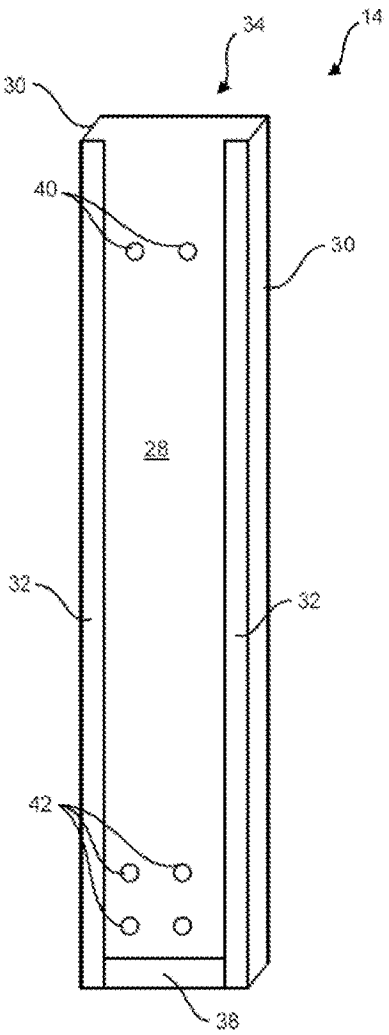
FIG. 3 is a perspective view of a C-shaped mounting channel of a sliding mount for a marine transducer in accordance with the principles of the invention.

The invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

The disclosed subject matter is described with reference to the drawings, wherein like reference numerals are used to refer to like elements throughout. In the following description, for purposes of explanation, numerous specific details are set forth in order to provide a thorough understanding of the various embodiments of the subject disclosure. It may be evident, however, that the disclosed subject matter may be practiced without these specific details. In other instances, well-known structures and devices are shown in block diagram form in order to facilitate describing the various embodiments herein.

Unless otherwise indicated, all numbers expressing quantities of ingredients, dimensions reaction conditions and so forth used in the specification and claims are to be understood as being modified in all instances by the term "about". The term "a" or "an" as used herein means "at least one" unless specified otherwise. In this specification and the claims, the use of the singular includes the plural unless specifically stated otherwise. In addition, use of "or" means "and/or" unless stated otherwise. Moreover, the use of the term "including", as well as other forms, such as "includes" and "included", is not limiting. Also, terms such as "element" or "component" encompass both elements and components comprising one unit and elements and components that comprise more than one unit unless specifically stated otherwise.

Various embodiments of the disclosure could also include permutations of the various elements recited in the claims as if each dependent claim was a multiple dependent claim incorporating the limitations of each of the preceding dependent claims as well as the independent claims. Such permutations are expressly within the scope of this disclosure.

Figure 2:
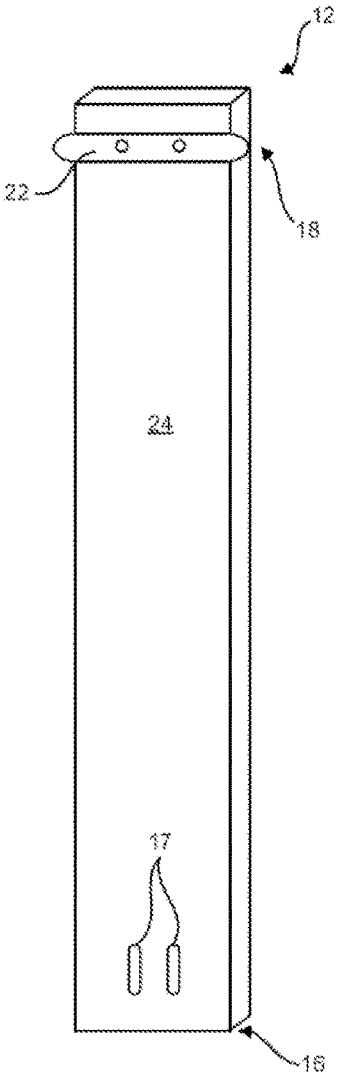
FIG. 2 is a perspective view of a mounting board of a sliding mount for a marine transducer in accordance with principles of the invention.
Figure 1:
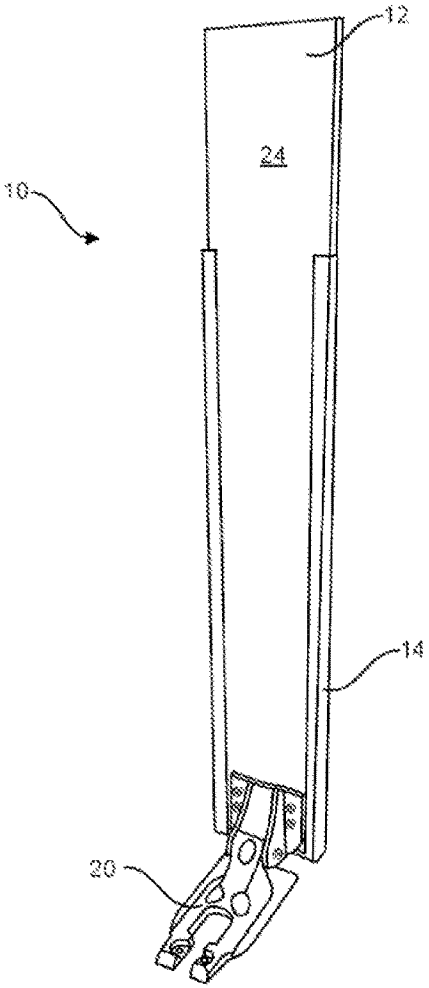
FIG. 1 is a perspective view of a sliding mount for a marine transducer in accordance with principles of the invention.

FIGS. 1-3 show a removable and reversible slide mount for a marine transducer 10 in accordance with the principles of the invention, which may be referred to in here as simply a slide mount for the sake of brevity. The slide mount 10 has two primary components: a rectangular mounting board 12 and a vertical C-shaped mounting channel 14. In this particular embodiment, the mounting board 12 is about 23 inches long, 3.5 inches wide and 0.5 inches deep. The mounting channel 14 is about 18 inches long, 3.5 inches wide and 0.5 inches deep.

The slide mount 10 has a mounting board 12 which removably slides into the mounting channel 14, shown together in FIG. 1 and individually in FIGS. 2 and 3, respectively. The mounting board 12 is an elongate, rectangular board made of any suitable marine plastic such as for example, high density polyethylene (HDPE). The mounting board 12 may optionally be made from a variety of materials suitable for use in a marine environment and is preferably UV stabilized. The mounting board 12 has a first end 16 and a second end 18. The first end 16 has two or more through holes 17 for attachment of a transducer. Attaching a transducer usually requires first attaching a transducer bracket 20 two the first end 16. The second end 18 has a handle 22 attached to the same front side 24 of the mounting board 12. In this embodiment, the handle 22 is simply a typical boat cleat.

The mounting channel 14 is a typical C-shaped channel having a back wall 28, two parallel flanges 30 and two lips 32. The two lips 32 are coplanar and extend from the parallel flanges 30 toward each other. The top 34 of the mounting channel 14 is open and the bottom 36 of the channel 14 is closed by a bottom plate 38. The channel 14 is sized to snugly fit around the mounting board 12, which may be slid into the channel 14 through the open top 34. The mounting board 12 may be slid into the channel 14 by inserting either the first end 16 or the second end 18 into the open top 34. The mounting channel 14 includes several through holes which may be used to bolt the mounting channel 14 to the transom of a boat. Those skilled in the art will appreciate that flush mounting bolts may be used to avoid obstructing the channel 14. In this embodiment, the backwall 28 includes two upper through holes 40 and four lower through holes 42.

Figure 4:
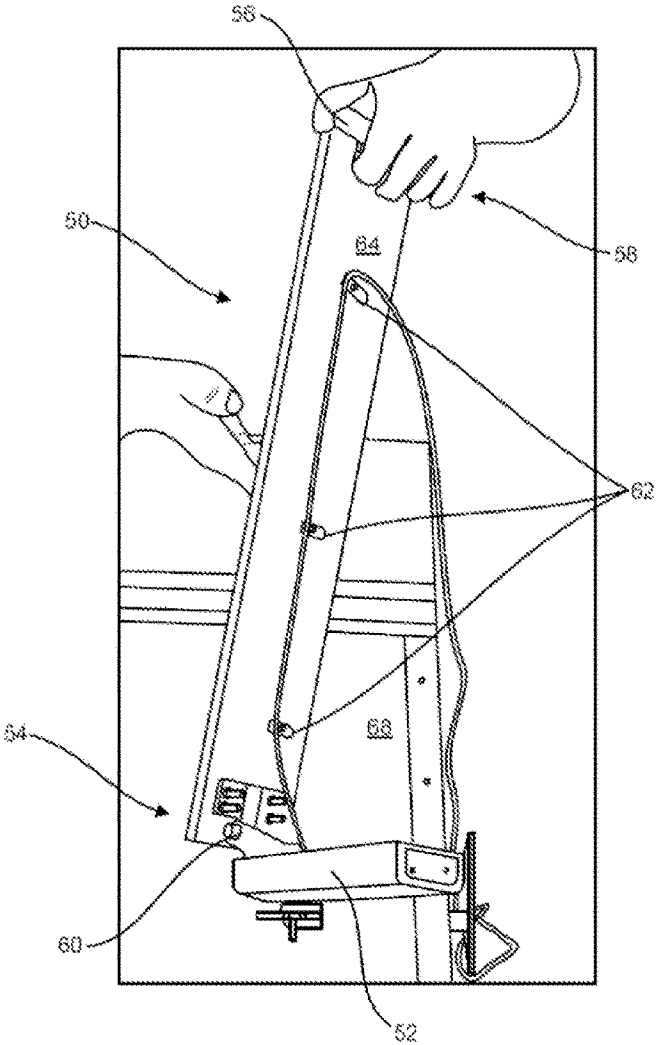
FIG. 4 is a perspective view of an alternative embodiment of a mounting board for a sliding mount for a marine transducer in accordance with the principles of the invention.

FIG. 4 shows a mounting board 50 having a transducer 52 attached to a first end 54 and a handle 56 attached to a second end 58. The transducer 52 is attached to the first end 54 of the mounting board 50 by means of a transducer bracket 60. Three cable guides 62 are also affixed to the front side 64 of the mounting board 50. The transducer 52 with its transducer bracket 60 as well as the handle 56 are also attached to the front side 64 of the mounting board 50. A transducer cable 68 extends from the transducer 52 through the cable guides 62 and are substantially taut to prevent them from catching on other objects. The cable 68 may optionally also be wound around the handle 56.

Figure 5:
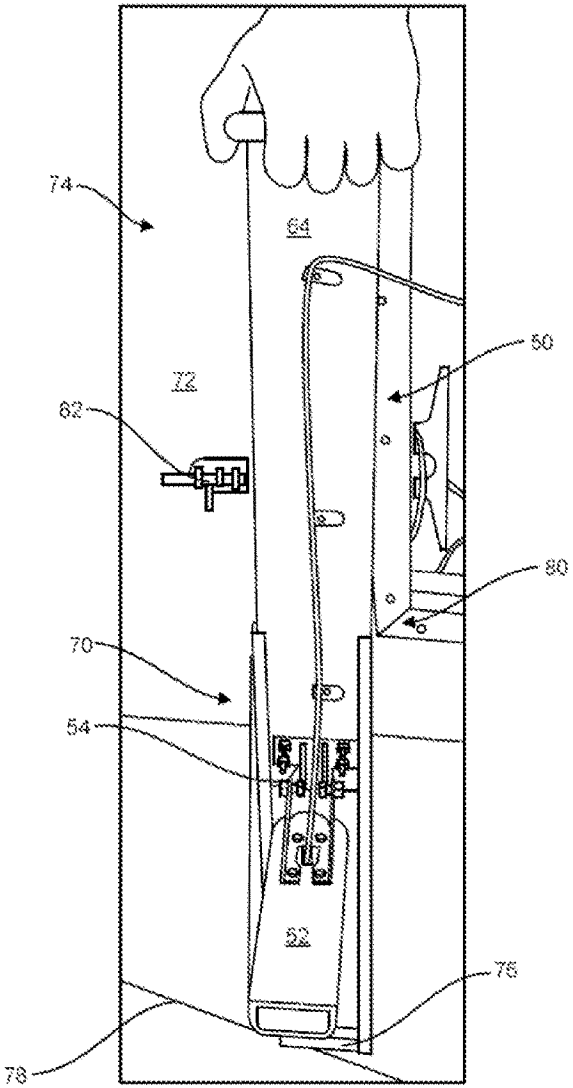
FIG. 5 is a perspective view of an alternative embodiment of a mounting board being inserted into a C-shaped mounting channel of a sliding mount for a marine transducer accordance with principles of the invention.
Figure 7:
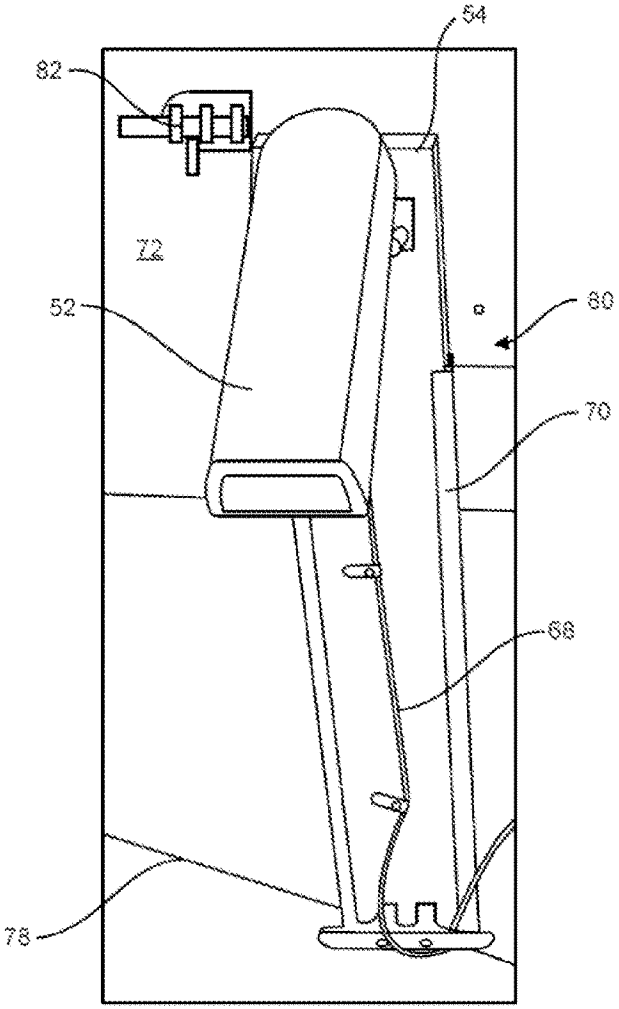
FIG. 7 is a perspective view of an alternative embodiment of a mounting board in an inverted configuration in a C-shaped mounting channel of a sliding mount for a marine transducer in accordance with principles of the invention.
Figure 6:
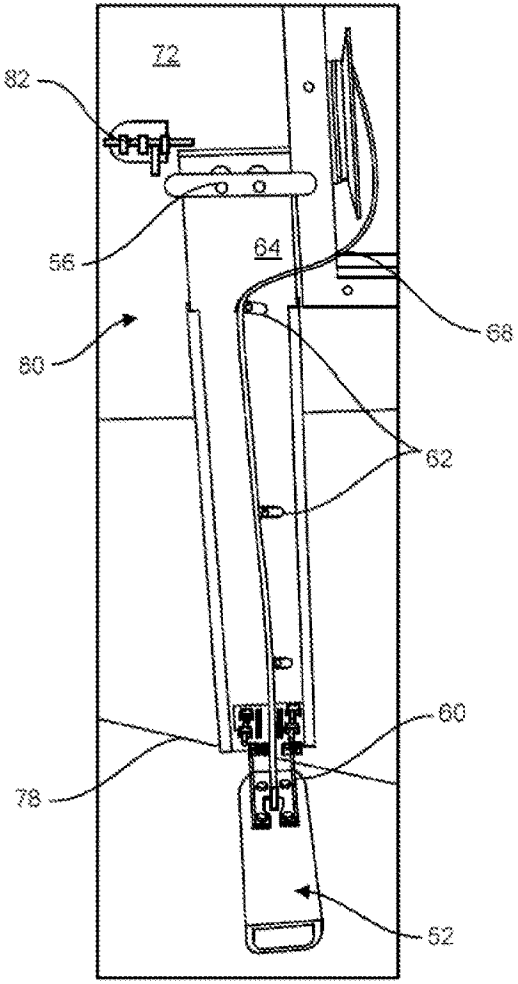
FIG. 6 is a perspective view of an alternative embodiment of a sliding mount for a marine transducer having and actuated locking mechanism in accordance with principles of the invention.

FIGS. 5-7 show a vertical C-shaped mounting channel 70 affixed to a transom 72 of a boat 74. The mounting channel 70 is positioned such that its closed bottom end 76 is proximal to the bottom 78 of the boat 74. The mounting channel 70 is also positioned such that it's open top end 80 is located above the water line of the boat. The mounting channel 70 is affixed such that it lies flush against the transom 72 and does not pivot or rotate. When the first end 54 of the mounting board 50 is inserted through the open top end 80 of the mounting channel 70, the mounting board 50 may be slid into the mounting channel 70, as shown in FIG. 5. The mounting board 50 is slid all the way down the mounting channel 70, as shown in FIG. 6, such that the transducer 52 is positioned just below the bottom 78 of the boat 74, allowing it to function properly. A locking mechanism 82 is attached to the transom 72 just above the location of the second end 58 of the mounting board 50 when it is fully inserted into the mounting channel 70. In this embodiment, the locking mechanism 82 is a sliding bolt lock. When the bolt is extended, as shown in FIG. 6, it prevents the mounting board 50 from sliding out of the mounting channel 70.

When the mounting board 50 is slid into the mounting channel 70 such that the transducer 52 is positioned just below the bottom 78 of the boat 74 and the locking mechanism 82 is actuated to secure the mounting board 50 in place, as shown in FIG. 6, the transducer 52 may be operated as intended during normal use of the boat 74. Should debris get caught on the transducer 52, the locking mechanism 82 may be disengaged and the mounting board 50 with the transducer 52 may be pulled up onto the boat and clean. The mounting board 50 may then be put back in place so that the transducer 52 may continue to be used.

When an operator of the boat 74 no longer wishes to utilize the transducer 52, the mounting board 50 may be removed and stored on the boat. Optionally, the mounting board 50 may also be inverted and reinserted into the mounting channel 70 as shown in FIG. 7. In this inverted configuration, the transducer 52 is suspended above the water line of the boat 74. This may be desirable for example when the boat encounters a substantial amount of debris for example in shallow water or when the boat has been berthed in a boat slip for an extended period. Suspending the transducer 52 above the water line in this inverted configuration prevents barnacles or other marine creatures from attaching to and/or damaging the transducer 52. This also reduces exposure of the transducer 52 to the deleterious effects of seawater. This inverted configuration may also be desirable when the boat 74 is being loaded onto a trailer. By moving the location of the transducer from the bottom 78 of the boat 74 to an elevated position, the possibility of inadvertently damaging the transducer 52 Lorri moving the boat 74 from the water is substantially reduced.

Affixing a transducer and the transducers bracket to a mounting board also simplifies the process of replacing a defective or outdated transducer. The mounting board may simply be removed from the mounting channel, the old transducer and transducer bracket may be removed and replaced on the mounting board itself, instead of removing and replacing a transducer on the transom itself. This is particularly advantageous when a new transducer and transducer bracket has a different configuration of bolt holes.

Whereas, the present invention has been described in relation to the drawings attached hereto, other and further modifications, apart from those shown or suggested herein, may be made within the spirit and scope of this invention. Those skilled in the art will appreciate that the conception, upon which this disclosure is based, may readily be utilized as a basis for the designing of other structures, methods and systems for carrying out the several purposes of the present invention. Descriptions of the embodiments shown in the drawings should not be construed as limiting or defining the ordinary and plain meanings of the terms of the claims unless such is explicitly indicated. The claims should be regarded as including such equivalent constructions insofar as they do not depart from the spirit and scope of the present invention.

The invention claimed is:

1. A removable and reversible sliding mount for marine a transducer comprising:

a C-shaped mounting channel affixed to a transom of a boat, having a closed bottom end and an open top end;

a removable mounting board having a first end and a second end, wherein the elongate mounting board is configured to slide into and out of the open top end of the C-shaped mounting channel by inserting either the first end or the second end of the elongate mounting board into the open top end of the C-shaped mounting channel;

a handle at the first end of the elongate mounting board;

a transducer attached to the second end of the elongate mounting board; and, a locking mechanism for securing the elongate mounting board in the vertical C-shaped mounting channel.

2. The removable and reversible sliding mount for a marine transducer of claim 1 wherein the C-shaped mounting channel is defined by a backwall, two parallel flanges, and two lips.

3. A method for storing a transducer above the waterline of a boat in water comprising:

affixing to a transom of the boat a C-shaped mounting channel having a closed bottom end proximal to a bottom of the boat and an open top end positioned above a water line of the boat;

attaching the transducer to a first end of a removable mounting board and a handle at a second end of the mounting board;

during use of the transducer, sliding the elongate mounting board into the vertical C shaped mounting channel by inserting the first end of the elongate mounting board into the open top end of the vertical C shaped mounting channel;

storing the transducer above the water line by removing the elongate mounting board from the vertical C shaped mounting channel, inverting the elongate mounting board, and sliding the elongate mounting board into the vertical C shaped mounting channel by inserting the second end of the elongate mounting board into the open top end of the vertical C shaped mounting channel; and, securing the inverted elongate mounting board within the vertical C shaped mounting channel using a locking mechanism.

4. The method for storing a transducer above the waterline of a boat in water of claim 3 wherein:

the C-shaped mounting channel has a length defined by a distance between the closed bottom end and the open top end;

the mounting board having a length defined by a distance between the first end and the second end; and the length of the mounting board is greater than the length of the C-shaped mounting channel.

5. The method for storing a transducer above the waterline of a boat in water of claim 4 wherein the locking mechanism is affixed to the transom above the C-shaped mounting channel at a position such that a distance between the locking mechanism and the closed bottom of the C-shaped mounting channel is equal to the length of the mounting board.

6. The method for storing a transducer above the waterline of a boat in water of claim 5 wherein the locking mechanism comprises a sliding bolt lock.

7. The removable and reversible sliding mount for a marine transducer of claim 1 wherein:

the C-shaped mounting channel is affixed to a transom of a boat and has a length defined by a distance between a closed bottom end and an open top end;

the removable mounting board has a length defined by a distance between a first end and a second end; and the length of the mounting board is greater than the length of the C-shaped mounting channel.

8. The removable and reversible sliding mount for a marine transducer of claim 7 wherein the C-shaped mounting channel is affixed to a transom of a boat and the locking mechanism is affixed to the transom above the C-shaped mounting channel at a position such that a distance between the locking mechanism and the closed bottom of the C-shaped mounting channel is equal to the length of the mounting board.

9. The removable and reversible sliding mount for a marine transducer of claim 8 wherein the locking mechanism comprises a sliding bolt lock.

* * * * *